US005463848A

United States Patent [19]

Gwiazdon et al.

[11] Patent Number: 5,463,848

[45] Date of Patent: Nov. 7, 1995

[54] APPARATUS FOR FOLDING AND EJECTING MICROWAVE POPCORN BAGS FROM A FIXTURE

[75] Inventors: Rodney K. Gwiazdon, St. Louis Park, Minn.; John E. Korte, Cedar Rapids, Iowa; Richard S. Deadmond, West Bend, Wis.; Frank C. Starr, New Berlin, Wis.; Robb W. Roloff, Pewaukee, Wis.; Robert D. Devlin, Milwaukee Wi

[73] Assignee: General Mills, Inc., Minneapolis, Minn.

[21] Appl. No.: 164,741

[22] Filed: Dec. 10, 1993

[51] Int. Cl.[6] ..... B65B 7/08; B65B 35/10

[52] U.S. Cl. ..... 53/482; 53/234; 53/252; 53/375.5

[58] Field of Search ..... 53/571, 252, 251, 53/250, 116, 243, 234, 225, 372.9, 375.5, 375.7, 482, 452, 429

[56] References Cited

U.S. PATENT DOCUMENTS

| | | | |
|---|---|---|---|
| 1,071,853 | 9/1913 | Young | 493/444 |
| 1,249,042 | 12/1917 | Dexter et al. | 271/107 |
| 1,886,552 | 11/1932 | Joplin | 53/284.7 |
| 1,909,319 | 5/1933 | Taylor | 53/284.7 |
| 2,364,543 | 12/1944 | Moore | 53/482 |
| 2,925,695 | 2/1960 | Fry | 53/482 |
| 2,952,959 | 9/1960 | Piazze | 53/284.7 |
| 3,462,070 | 8/1969 | Corella | 229/56 |
| 3,493,226 | 2/1970 | Weir | 493/449 |
| 3,503,179 | 3/1970 | Pierre | 53/386.1 |
| 3,570,751 | 3/1971 | Trewella | 229/66 |
| 3,608,709 | 9/1971 | Pike | 206/219 |
| 3,615,711 | 10/1971 | Markus et al. | 229/66 X |
| 3,632,104 | 1/1972 | Dufour | 493/444 |
| 3,720,559 | 3/1973 | Odom et al. | 53/482 |
| 3,745,892 | 7/1973 | Ganz | 493/125 |
| 3,788,035 | 1/1974 | Geisel | 53/282 |
| 3,854,385 | 12/1974 | Wallin | 493/124 |
| 3,955,334 | 5/1976 | Wild et al. | 53/571 |
| 4,019,305 | 4/1977 | McGhie et al. | 53/482 |

(List continued on next page.)

FOREIGN PATENT DOCUMENTS

| | | | |
|---|---|---|---|
| 569335A | 5/1993 | European Pat. Off. . | |
| 565303 | 11/1932 | Germany . | |
| 635952 | 9/1936 | Germany . | |
| 2714584 | 11/1978 | Germany . | |
| 8213834 | 5/1981 | Germany | 53/567 |
| 0002123 | 5/1976 | Japan | 493/457 |
| 9315976 | 8/1993 | WIPO . | |

OTHER PUBLICATIONS

SIG Pouch Packaging Machine Type RF; SIG Swiss Industrial Company, CH–8212 Neuhausen Rhine Falls, Packaging Technology Division; Raymond Automation Company, Inc., Norwalk, Conn. (No Date).

*Primary Examiner*—James F. Coan

*Attorney, Agent, or Firm*—L. MeRoy Lillehaugen; John A. O'Toole; Alan D. Kamrath

[57] ABSTRACT

An apparatus (10) is disclosed including a first pushing plate (172) removably secured to a second pushing plate (174) and movable to eject bags (12) from fixtures (32) into pockets (186). The second pushing plate (174) ejects any defective bags (12) remaining when the first pushing plate (172) is not secured or movable with the second pushing plate (174) in the prior intermittent position. The pockets (186) are rotatable to an inverted position where the bags (12) are removed by lugs (230) upstanding from movable lands (228). The lands (228) are pivotable to be in a non-interfering position with the rotation of the pockets (186). A finger (294) is pivotally mounted to a vertically reciprocated carriage (288) to place the bags (12) on conveyors (200) from the lands (228). In the preferred form, a bending bar (184) is positioned to prevent the bags (12) from flying out of the fixtures (32) as they move in the operation direction from a horizontal portion to a vertical portion and to fold back the portions of the bags (12) extending out of the fixtures (32) before they are ejected from the fixtures (32) by the first pushing plate (172).

40 Claims, 5 Drawing Sheets

U.S. PATENT DOCUMENTS

| | | | |
|---|---|---|---|
| 4,033,093 | 7/1977 | Mencacci | 53/571 |
| 4,061,327 | 12/1977 | Blessing | 493/457 |
| 4,084,391 | 4/1978 | Williams, Sr. et al. | 493/457 |
| 4,108,300 | 8/1978 | Hayase et al. | 53/386.1 |
| 4,201,118 | 5/1980 | Calvert | 493/125 |
| 4,257,209 | 3/1981 | Tetenborg et al. | 53/375.7 |
| 4,257,210 | 3/1981 | Tetenborg et al. | 53/375.7 |
| 4,320,615 | 3/1982 | Gmur | 53/386.1 |
| 4,337,862 | 7/1982 | Suter | 206/632 |
| 4,348,853 | 9/1982 | Morse et al. | 53/571 |
| 4,450,180 | 5/1984 | Watkins | 426/107 |
| 4,548,826 | 10/1985 | Watkins | 426/394 |
| 4,604,854 | 8/1986 | Andreas | 53/552 |
| 4,621,480 | 11/1986 | Aiuola et al. | 53/234 |
| 4,669,249 | 6/1987 | Aiuola et al. | 53/234 |
| 4,691,374 | 9/1987 | Watkins et al. | 383/104 |
| 4,735,513 | 4/1988 | Watkins et al. | 383/116 |
| 4,845,924 | 7/1989 | Focke et al. | 53/234 X |
| 4,861,325 | 8/1989 | DiMarzio et al. | 493/124 |
| 4,873,815 | 10/1989 | Tetenborg et al. | 53/571 |
| 4,878,765 | 11/1989 | Watkins et al. | 383/116 |
| 4,890,439 | 1/1990 | Smart et al. | 53/410 |
| 5,044,777 | 9/1991 | Watkins et al. | 383/100 |
| 5,171,950 | 12/1992 | Brauner et al. | 219/10.55 E |
| 5,180,357 | 1/1993 | Marzullo | 493/420 |
| 5,269,117 | 12/1993 | Boriani et al. | 53/234 |

10
60
186
188
190
192
194
196
198
200
238
240
286
288
290
292
294
296
298
300
302
304

APPARATUS FOR FOLDING AND EJECTING MICROWAVE POPCORN BAGS FROM A FIXTURE

BACKGROUND

The present invention generally relates to apparatus for ejecting bags, particularly to apparatus for ejecting bags for food products, more particularly to apparatus for folding and ejecting bags, and specifically to apparatus for folding and ejecting microwave popcorn bags.

Popcorn is a highly popular snack food item. In the past, the at-home preparation of popcorn by the consumer involved adding kernel popcorn plus a cooking oil to a covered pot and heating until the popcorn kernels popped to make popcorn. As used herein, "kernel popcorn" refers to unpopped popcorn. The noun "popcorn" or synonymously "popped popcorn" refers herein to popped kernel popcorn. The adjective "popcorn" can refer to either.

More recently, microwave popcorn products have become extremely popular. At present, in the United States of America, over 70 different brands of microwave popcorn products are available. In general, the more popular microwave popcorn products comprise an expandable paper bag containing a charge of kernel popcorn, fat and salt. The microwave popcorn article is adapted to be heated in a microwave oven for three to five minutes to produce the popped popcorn. More recently, improved microwave popcorn articles have been fabricated employing a metallized susceptor which facilitates the heating of the popcorn-fat charge and which, in turn, leads desirably to increases in popcorn volume and decreases in unpopped kernels. Microwave popcorn articles of this type are described in detail in, for example, U.S. Pat. No. 4,450,180 (issued May 22, 1984 to J. D. Watkins and incorporated herein by reference).

The prior art is replete with various apparatus and methods for filling and sealing microwave popcorn bags and in some cases folding the bag generally into a central portion having first and second wing portions extending from opposite ends thereof from folds. For example, U.S. Pat. Nos. 4,450,180; 4,548,826; 4,604,854; and 5,171,950 show techniques for filling and sealing microwave popcorn bags. Particularly, the charge of popcorn, fat and salt could be dropped as a prefabricated toroid- or doughnut-shaped piece into an open end of the bag prior to its sealing. More recently, the popcorn, fat in the form of a slurry, and salt are filled in the open end of the bag prior to its sealing. However, changes in the marketing of microwave popcorn have created demand for improved techniques for folding and/or ejecting microwave popcorn bags from a fixture. Specifically, with the increasing competitiveness of the microwave popcorn business, a need exists for apparatus and methods which achieve higher output speeds in "bags per minute" while reducing the amount of labor, downtime, and floor space required. Additionally, with the reduction in the amount of material and/or layers utilized in the formation of paper popcorn packages including a microwave susceptor such as shown and described in International Publication No. WO 93/15976 published on Aug. 19, 1993, a need exists for apparatus and methods which are capable of running bags of flimsy construction as well as reducing product and material damage. Additionally, with the introduction of various types and sizes of bags to meet particular market types and conditions and for enhancing product performance, a need exists for apparatus and methods which are capable of handling different sizes of bags such as single or multiple serving sizes, and/or different types such as gusseted or non-gusseted bags, and/or different configurations of bags.

SUMMARY

The present invention solves these needs and other problems in the field of opening microwave popcorn bags or the like by providing, in the most preferred form, a finger having a free end in a spaced condition from a bag and a land in a first position and abutting with the bag in a second position, with the finger being in the first position while the land and the bag moves from an inner position to an outer position and being in the second position while the land moves from the outer position to the inner position.

In further aspects of the present invention, a first pushing plate is releasably secured to a second pushing plate for movement with the second pushing plate, with the first pushing plate ejecting bags from the fixture in a first position when the second pushing plate is moved from a retracted position to an extended position, with the second pushing plate ejecting any remaining bags from the fixture in a second position when moved from the retracted position to the extended position.

Also, in other aspects of the present invention, the portion of a bag extending beyond a fixture engages a stationary bending bar as the fixture moves from a first position to a second position to create a fold in the bag, with the stationary bending bar holding the portion of the bag extending beyond the fixture at a nonlinear angle to the portion of the bag located in the fixture when the fixture is in the second position and before the bag is ejected from the fixture by a pushing plate.

Further, in other aspects of the present invention, a pushing plate moves in a movement direction between a retracted position and an extended position, with the pushing plate ejecting bags from a fixture in the second position when the pushing plate moves from the retracted position to the extended position, with a pocket located in line with the movement direction of the pushing plate from the fixture, with the pocket being of a size for slideable receipt of the bag, with the pocket slideably receiving the bag when the bag is ejected from the fixture by the pushing plate.

Furthermore, in other aspects of the present invention, a pocket is movable between a first position and a second, inverted position, with the pocket receiving a bag in the first position and the bag being removed from the pocket in the second, inverted position.

It is thus an object of the present invention to provide a novel apparatus for folding and/or ejecting bags.

It is further an object of the present invention to provide such a novel bag-folding and/or ejecting apparatus achieving higher output speeds in "bags per minute" than current technology.

It is further an object of the present invention to provide such a novel bag-folding and/or ejecting apparatus providing positive control of the bags.

It is further an object of the present invention to provide such a novel bag-folding and/or ejecting apparatus capable of running various types and sizes of bags including gusseted and non-gusseted bags, multi- or single-ply paper bags, or bags of flimsy-type structure.

It is further an object of the present invention to provide such a novel bag-folding and/or ejecting apparatus which is very compact, minimizing floor surface and work space required.

It is further an object of the present invention to provide such a novel bag-folding and/or ejecting apparatus which is easily accessible from the floor for trouble shooting, maintenance, and the like.

It is further an object of the present invention to provide such a novel bag-folding and/or ejecting apparatus allowing easy changeover for different sized bags and for reducing down time.

It is further an object of the present invention to provide such a novel bag-folding and/or ejecting apparatus reducing product loss and which separates defective bags.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
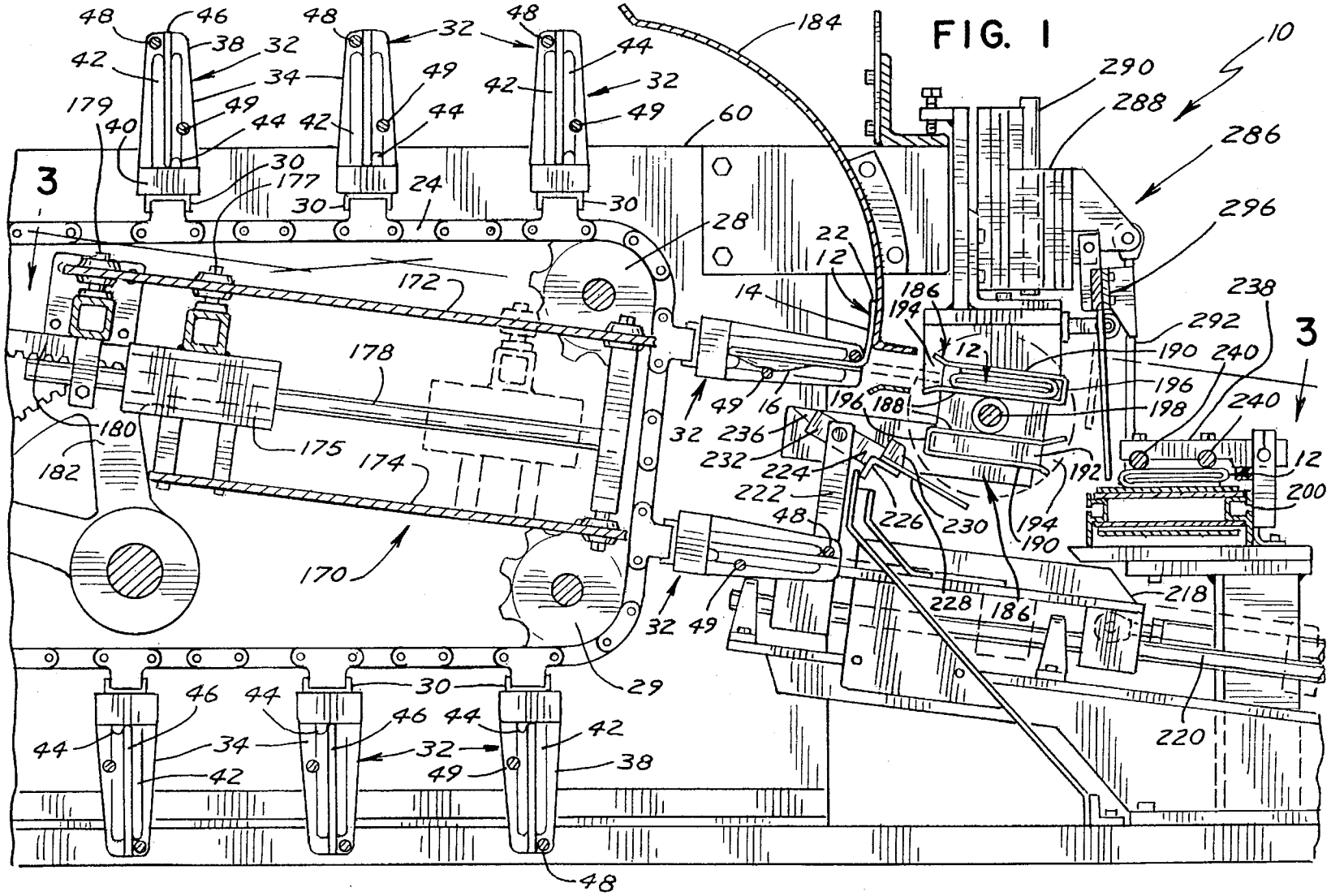
FIG. 1 shows a cross sectional view of a microwave popcorn bag folding and ejecting device according to the preferred teachings of the present invention.
Figure 2:
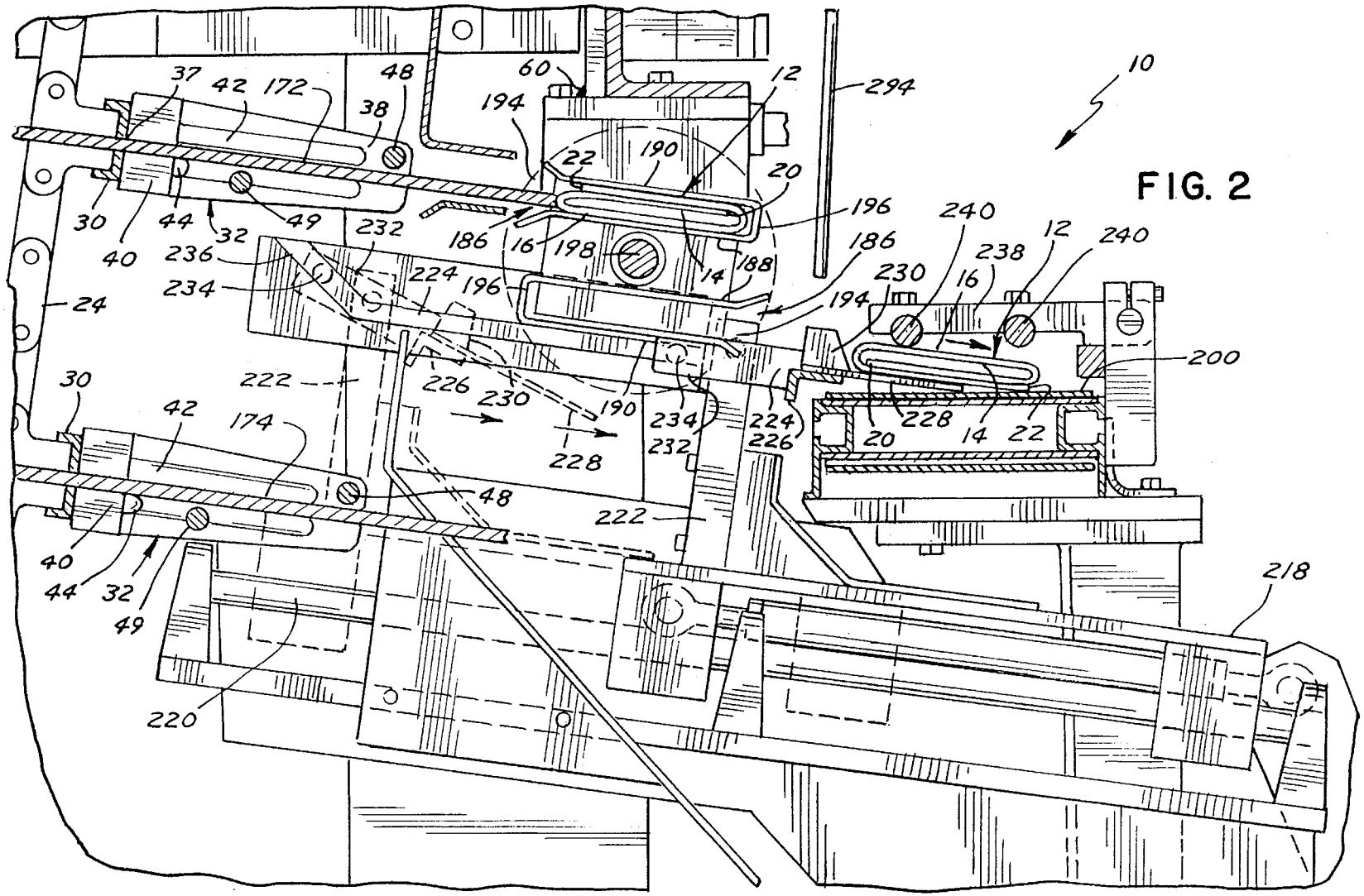
FIG. 2 shows a partial, enlarged, cross sectional view of the microwave popcorn bag folding and ejecting device of FIG. 1.
Figure 3:
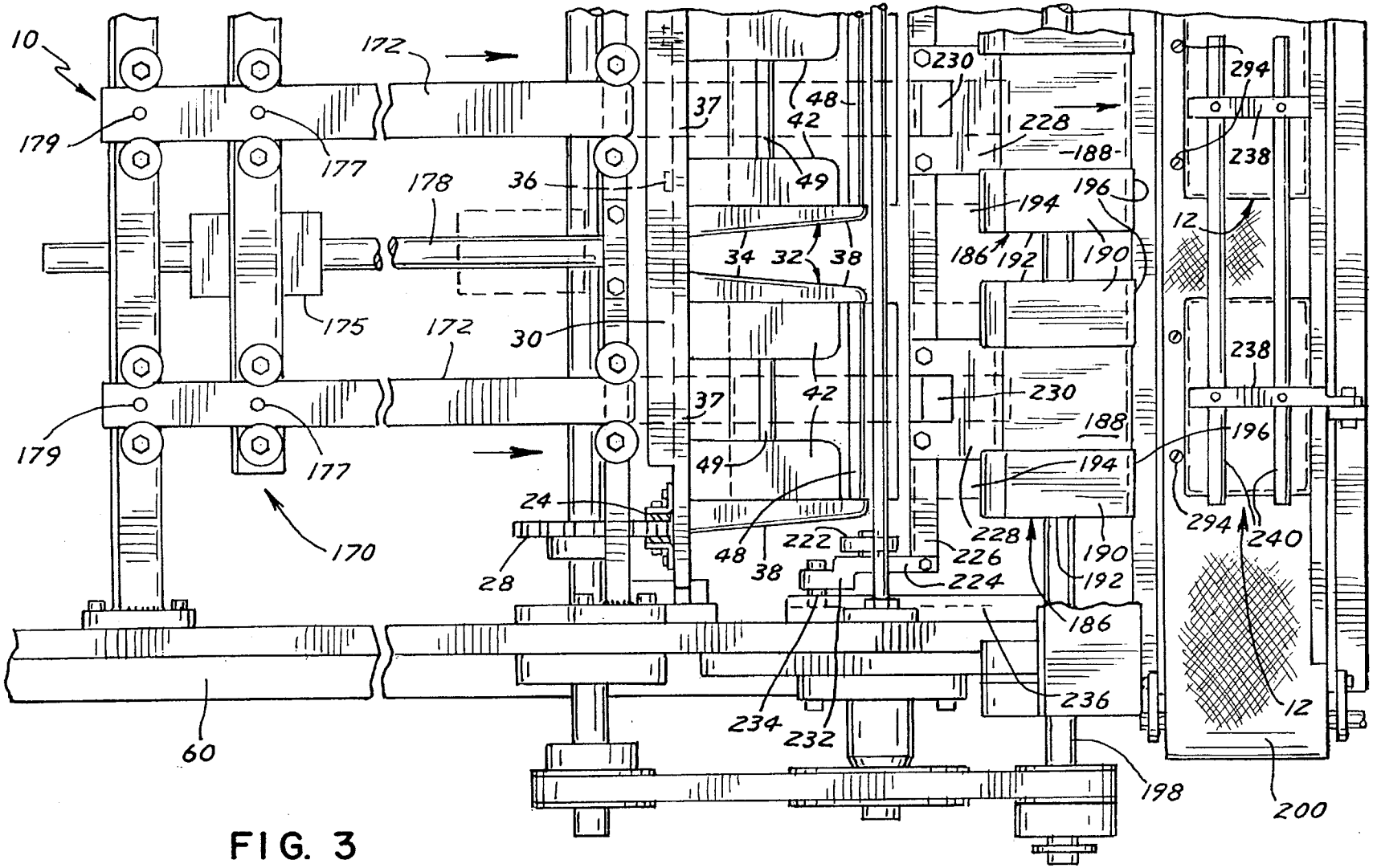
FIG. 3 shows a cross sectional view of the microwave popcorn bag folding and ejecting device of FIG. 1 according to section line 3—3 of FIG. 1.
Figure 4:
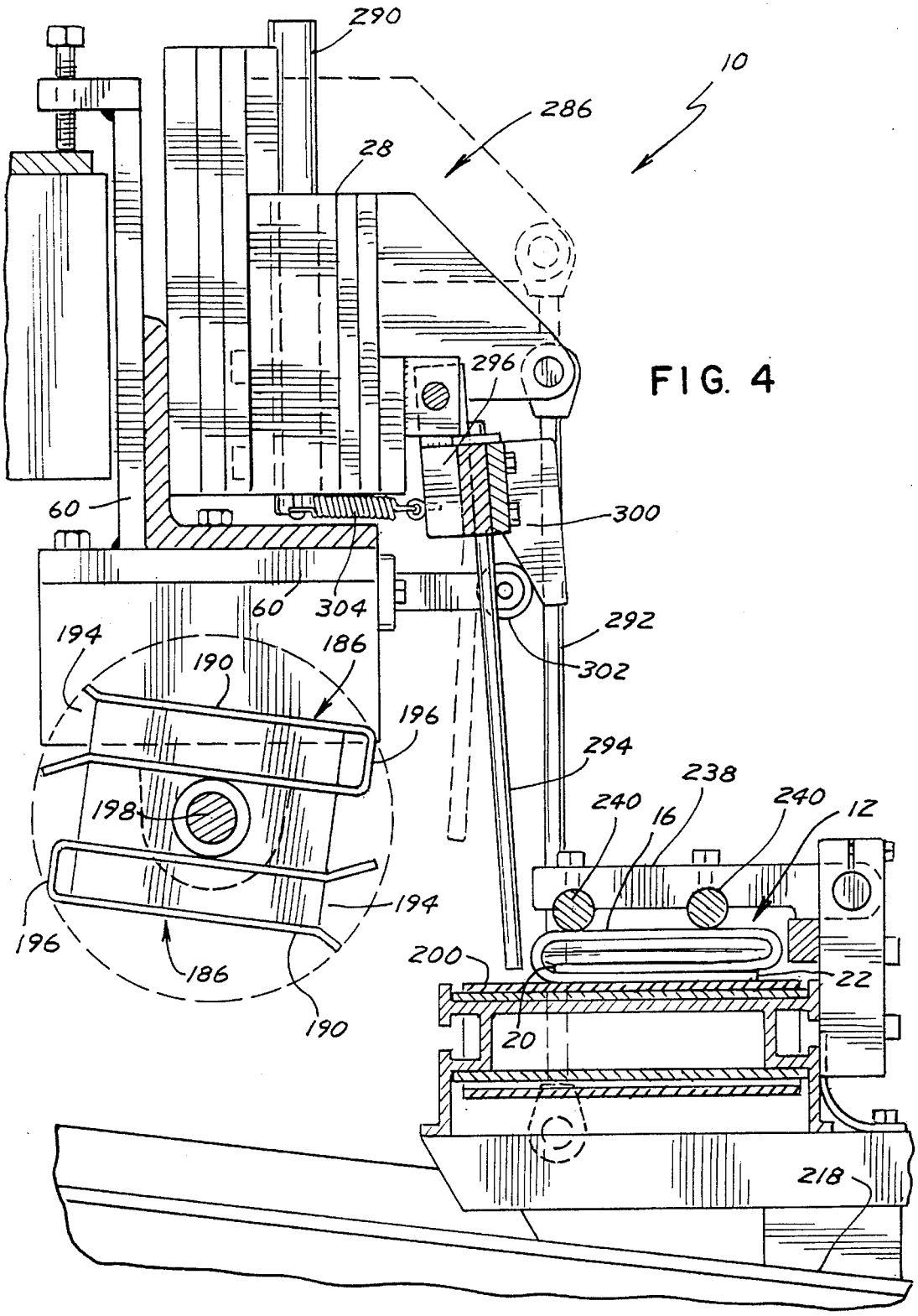
FIG. 4 shows a partial, cross sectional view of the microwave popcorn bag folding and ejecting device of FIG. 1.
Figures 5, 6:
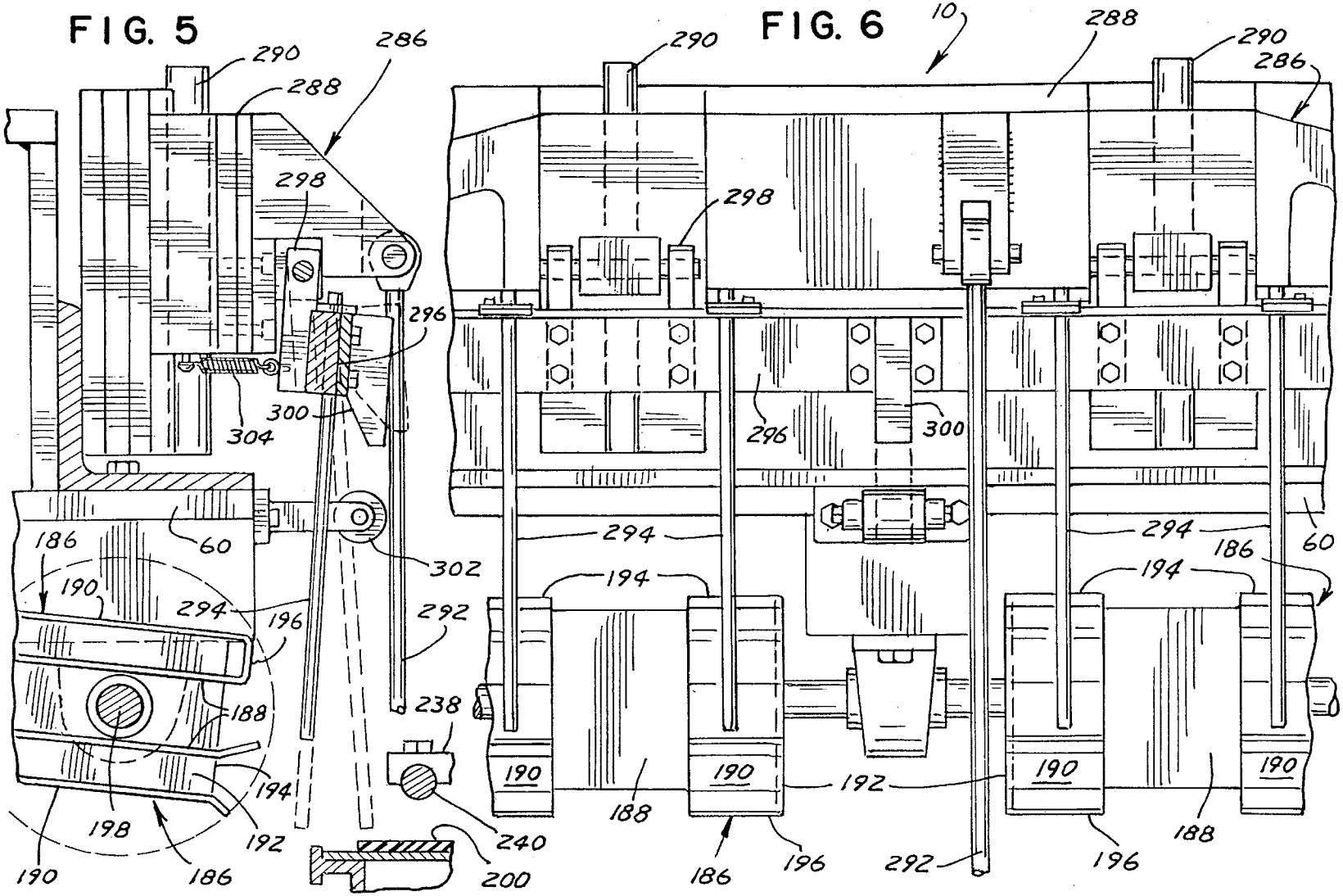
FIG. 5 shows a partial, enlarged, cross sectional view of the microwave popcorn bag folding and ejecting device of FIG. 1.
FIG. 6 shows an end view of the microwave popcorn bag folding and ejecting device of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for folding and/or ejecting bags 12 according to the preferred teachings of the present invention is shown in the drawings and generally designated 10. In the most preferred form, bags 12 are of the current type for the marketing of microwave popcorn and each include a top 14, a bottom 16 including the microwave susceptor, first and second gusseted sides 18, a first, lower, sealed end 20, and a second, upper, unsealed end 22. In the most preferred form, bottom 16 has a width less than top 14. Each side 18 includes a top gusset pivotally connected to top 14 about a fold line and includes a bottom gusset pivotally connected to bottom 16 about a fold line and also pivotally connected to the corresponding top gusset. It should be noted that bags 12 can be of other types and varieties than bags 12 as shown, such as but not limited to bags 12 where top 14 and bottom 16 are of equal or different widths, nongusseted bags 12, or the like. Also, bags 12 can be formed of various types of materials including paper of either multi-ply or single-ply variety, plastic, and like materials including flimsy-type materials.

Apparatus 10 generally includes at least first and second roller chains 24 arranged as closed loops extending around sets of sprockets 28 and 29. Multiple carrier bars 30 are provided including first portions secured to roller chains 24 at equal circumferential spacing along the closed loops. Each carrier bar 30 includes a second portion having a plurality of bag-holding fixtures 32 secured thereto corresponding to the number of lanes of bags 12 which are being filled and sealed in apparatus 10, with 4 lanes being provided in apparatus 10 and 4 fixtures 32 being provided on each carrier bar 30 in the preferred form. The first and second portions of bars 30 are removably secured together such as by bolts. It can then be appreciated that changeover for different sized bags can be easily accomplished and/or down time is reduced in the event of fixture contamination, breakage, or the like by simply replacing the second portions of bars 30 with fixtures 32 secured thereon. Any cleaning or repair can be accomplished while the second portions of bars 30 and fixtures 32 secured thereon are removed from apparatus 10 and as apparatus 10 continues to operate with other, replacement, second portions of bars 30 and fixtures 32 secured thereon being secured to the first portions of bars 30 secured to roller chains 24.

In the most preferred form, fixtures 32 each include first and second fixture halves 34 secured in a spaced relation to the second portions of bars 30 by suitable means such as bolts 36. An aperture 37 is formed in bars 30 intermediate halves 34 of each fixture 32. Each half 34 includes a side plate 38 and a bottom plate 40 extending generally perpendicular to the bottom ends of plate 38. Each half 34 further includes a support plate 42 of a generally rectangular configuration and extending generally perpendicular to side plates 38 and bottom plate 40. Each half 34 further includes an abutment 44 of a generally L-shaped configuration having a first leg secured and extending generally perpendicular to plate 38 and a second leg secured to and extending generally perpendicular to plate 40. In the most preferred form, the first and second legs of abutment 44 include an arcuate portion at their interconnection. Abutment 44 has arcuate inside edges and provides a camming surface opposite to support plate 42. Support plate 42 and abutment 44 are generally parallel and spaced from each other and form a slot 46 therebetween for receiving the side edges of bag 12. Side plates 38 further include bores for slideably receiving the ends of a folding bar 48, with bar 48 being captured in the bores of side plates 38 of the first and second fixtures halves 34 forming each fixture 32. The forward extent of bar 48 is generally equal to the forward extent of support plates 42 of halves 34 of fixtures 32. The first legs of abutment 44 include bores for slideably receiving the ends of an expansion prevention bar 49, with bar 49 being captured in the bores of abutment 44 of the first and second fixture halves 34 forming each fixture 32.

It can then be appreciated that as roller chains 24 move around sprocket sets 28 and 29, bars 30 and fixtures 32 carried thereby are positioned along the closed loop arrangement of roller chains 24, with chains 24 being movable in an operation direction intermittently by any suitable means in the most preferred form.

After sealing in the intermittent sealing position, carrier bars 30 and fixtures 32 mounted thereon and bags 12 held therein are moved to the next, intermittent position in the preferred form.

Apparatus 10 includes a device 170 for ejecting bags 12 from fixtures 32, with device 170 ejecting marketable bags 12 from one intermittent position of fixtures 32 and ejecting defective bags 12 from the next intermittent position of fixtures 32. Specifically, in the most preferred form, device 170 includes first and second pushing plates 172 and 174 arranged in spaced, parallel relations. Pushing plates 172 and 174 have widths for slideable receipt in apertures 37 of carrier bars 30 between halves 34 of fixtures 32, with plates 172 extending through apertures 37 of carrier bar 30 in the intermittent position just prior to the intermittent position that plates 174 extend through apertures 37 of carrier bar 30. Plates 172 and 174 are generally horizontally movable between a retracted position and an extended position. Specifically, in the most preferred form, plates 174 are secured to a mount bar 175 in laterally spaced positions corresponding to fixtures 32 on carrier bars 30. Mount bar 175 is longitudinally movably mounted by first and second slide blocks which are slideably mounted on support shafts 178. In the most preferred form, a rack gear 180 secured to mount bar 175 intermediate the slide blocks is moved by rotation of a gear 182 to slide the slide blocks on shafts 178 to longitudinally move mount bar 175 and plates 174 between their retracted and extended positions. In the most preferred form, plates 172 are slideably mounted to frame 60 and individually, releasably secured to mount bar 175 such as by the use of an air cylinder 177. Additionally, plates 172 are individually releasably secured to frame 60 such as by the use of an air cylinder 179. In the preferred form, air cylinders 177 and 179 extend and retract a pin from an aperture formed in plates 172. In operation, after fixtures 32 have moved to the first intermittent position in ejecting device 170 and with air cylinders 177 securing plates 172 to mount bar 175 and air cylinders 179 being released from plates 172, plates 172 and 174 are moved from their retracted positions to their extended positions to push bags 12 from fixtures 32. However, if a bag 12 has been previously detected as being defective, the securement of plate 172 to mount bar 175 by air cylinder 177 is released and air cylinder 179 secures plate 172 to frame 60 for that particular lane such that plate 172 does not move with mount bar 175 and plate 174. Fixtures 32 are then moved to their next intermittent position. It can then be appreciated that any bags 12 remaining in fixtures 32 will be pushed therefrom by plates 174 in the next movement of plates 172 and 174, with plates 172 ejecting the marketable bags 12 from the next fixtures 32 in the continuous loops of chains 24 and plates 174 ejecting any defective bags 12 remaining in fixtures 32 or simply sliding through fixtures 32 if marketable bags 12 had been previously ejected therefrom. The free ends of plates 172 and 174 may include a concave surface or compressible material so that they do not slide beyond the end of bags 12 in fixtures 32.

Stationary guides 184 are attached to frame 60 to prevent bags 12 from moving from slots 46 of fixtures 32 under centrifugal forces as fixtures 32 move around sprocket 28 moving from the horizontal portion to the generally vertical portion of the closed loops of chains 24. The inlets of guides 184 are spaced from fixtures 32 to an extent equal to that of the portions of bags 12 extending beyond fixtures 32. Apparatus 10 according to the preferred teachings of the present invention includes suitable provisions for folding bags 12 into three generally equal portions in their commercialized form. In the most preferred form, guides 184 are configured and positioned in frame 60 adjacent to the closed loops of roller chains 24 to fold the portions of bags 12 extending beyond fixtures 32 about folding bar 48 of fixtures 32 as carrier bar 30 moves in guides 184 and into the intermittent position that plates 172 eject marketable bags 12 from fixtures 32. In the most preferred form, guides 184 hold the portions of bags 12 extending beyond fixtures 32 generally perpendicular to the portions of bags 12 located within fixtures 32 and to slots 46 of fixtures 32 when carrier bar 30 is located in the intermittent position that plates 172 eject marketable bags 12 from fixtures 32 and prior to bags 12 being ejected from fixtures 32.

Bags 12 are pushed from fixtures 32 by plates 172 into pockets 186, with bags 12 being folded and held in a planar form of three generally equal portions as bags 12 are pushed into pockets 186. In the most preferred form, each of the pockets 186 is formed by a first generally closed bottom 188, a top 190 formed by first and second plates arranged parallel to and spaced from bottom 188 and spaced from each other, first and second sides 192 extending perpendicular between bottom 188 and top 190, a first open end 194, and a second end 196 formed by first and second plates extending perpendicularly between bottom 188 and top 190 and perpendicular to sides 192 and spaced from each other the same distance that the plates forming top 190 are spaced. In the most preferred form, top 190, sides 192, and end 196 are formed integrally together.

As plates 174 eject bags 12 from fixtures 32, movement of bags 12 out of fixtures 32 causes the upper portions of bags 12 initially folded about the fold created by folding bar 48 to continue to fold from a perpendicular angle to an angle smaller than 90° to a position generally parallel to lower and central portions of bags 12 and sandwiching the lower portion between the upper portions and the central portions. Prior to ends 22 of bags 12 being pushed from beneath guides 184, the leading edges of folded bags 12 which would be the fold between the upper and central portions of bags 12 extend through open end 194 and into pockets 186, with bottom 188 and top 190 being generally parallel to and in line with slots 46 and being spaced a distance generally equal to and for slideable receipt of bags 12 in their commercialized form. When plates 172 push bags 12 from fixtures 32, plates 172 push bags 12 into pockets 186 and generally within open end 194 of pockets 186.

In the preferred form, pockets 186 have a first, bag receiving position and a second, inverted position. In the most preferred form, each lane of apparatus 10 includes first and second pockets 186 positioned on opposite sides of a shaft 198 rotatable in frame 60 about a horizontal axis. Specifically, bottoms 188, tops 190, and ends 194 and 196 are located on opposite sides of shaft 198 with tops 190 located radially outwardly of bottoms 188 from shaft 198. In the first, bag-receiving position, pockets 186 are aligned with fixtures 32 in the intermittent position that plates 172 eject marketable bags 12 from fixtures 32. In the second, inverted position, pockets 186 are located below pockets 186 in their first, bag-receiving position with tops 190 located below bottoms 188 and with open end 194 being located on the opposite side of end 196 than fixtures 32.

Apparatus 10 further includes a device 200 for transporting bags 12 from pockets 186 to further processing stations such as wrapping, packaging and the like, with two laterally extending conveyors 200 moving in opposite directions to opposite sides of apparatus 10 being provided in the most preferred form, with each conveyor 200 receiving bags 12 from the two lanes of apparatus 10 adjacent the side of delivery. Apparatus 10 further includes provisions for removing bags 12 from pockets 186 in their second, inverted position and placing bags 12 on conveyors 200. In the preferred form, a carriage 218 is slideably mounted on longitudinally extending support shafts 220 between a first inner position and a second outer position. Carriage 218 includes a plurality of uprights 222 located intermediate the lanes of fixtures 32. Pivotally mounted to the upper ends of uprights 222 are arms 224. The free ends of arms 224 are secured to a laterally extending bar 226. Support lands 228 are secured to bar 226 corresponding to the lanes of apparatus 10 and particularly pockets 186 thereof and have a width corresponding to the width of bags 12. Each land 228 includes an upright lug 230 extending therefrom and having a width and positioned for slideable receipt between the plates forming top 190 of pockets 186. In the most preferred form, arms 224 and bar 226 are pivoted by extensions 232 formed on the two outer arms 224 extending on the opposite side of uprights 222 than bar 226, with extensions 232 having cams 234 slideably received in cam tracks 236 attached to frame 60.

In operation, after bags 12 have been inserted into pockets 186 in their first, bag-receiving position by plates 172, pockets 186 are rotated by shaft 198 to their second inverted position. It should be noted that when pockets 186 are rotated, carriage 218 is located in its first inner position and arms 224 and bar 226 are pivoted by cams 234 and cam tracks 236 such that lands 228 are in a non-interferring relation with rotation of pockets 186 about shaft 198. Additionally, it can be appreciated that when pockets 186 including bags 12 are rotated from their first, bag-receiving position to their second, inverted position, pockets 186 on the opposite diametric side of shaft 198 (which do not include bags 12) are simultaneously rotated from their second, inverted position to their first, bag-receiving position. At that time, carriage 218 moves from its first, inner position to its second, outer position. With movement of carriage 218, arms 224 and bar 226 are pivoted by cams 234 and cam tracks 236 such that lands 228 are located below and generally parallel to top 190. With further movement of carriage 218, lugs 230 of lands 228 pass between the plates forming end 196 and top 190 and engage bags 12 located in pockets 186 in their second, inverted position. With further movement of carriage 218, lugs 230 push bags 12 located in pockets 186 onto lands 228 for movement thereon. When carriage 218 is located in its second, outer position, bags 12 and lands 228 are positioned over conveyors 200.

With bags 12 positioned over conveyors 200, carriage 218 is moved from its second, outer position to its first, inner position. To remove bags 12 from lands 228 and prevent bags 12 from riding back with lands 228, device 286 is provided including a carriage 288 vertically reciprocally mounted such as on shafts 290 by linear bearings. Carriage 288 is reciprocated by suitable means such as by an arm 292 pivotally connected thereto and reciprocated by suitable means such as a crank arm, cam assembly, or the like, not shown. Device 286 further includes fingers 294 pivotally mounted by their upper ends to carriage 288, with one finger 294 provided for each lane of apparatus 10 in the preferred form. In the most preferred form, fingers 294 are secured to a mounting plate 296 in turn pivotally mounted to carriage 288 by ears 298 extending therefrom. Cams 300 are mounted to mounting plate 296 which engage stationary rotatable cam followers 302 mounted to frame 60. Mounting plate 296 is biased inwardly by springs 304 extending between carriage 288 and mounting plate 296.

In operation, carriage 288 is located in its vertically upper position, with cams 300 spaced from cam follower 302 and mounting plate 296 and fingers 294 secured thereto biased in their inner position by springs 304. When bags 12 and lands 228 are positioned over conveyors 200, carriage 288 slides on shafts 290 vertically downwardly to lower fingers 294 such that the lower ends thereof are positioned behind bags 12 and above lands 228. Additionally, prior to reaching the vertically lower position of carriage 288, cams 300 engage with cam followers 302 to pivot fingers 294 from their inner positions to their outer positions against the bias of springs 304 to push bags 12 outwardly of lands 228 and onto conveyor 200. It can be appreciated that once fingers 294 are positioned behind bags 12, lands 228 can be moved from the outer positions to the inner positions, with the abutment of bags 12 with fingers 294 preventing bags 12 from riding back with lands 228. With bags 12 removed from lands 228 and positioned on conveyors 200, carriage 288 can be moved from its lower position to its upper position. It can be appreciated that as carriage 288 moves vertically upwardly, cams 300 will ride up on followers 302 and allow springs 304 to pivot fingers 294 relative to carriage 288 from their outer positions to their inner positions. It can then be appreciated that the motion of carriage 288 in a single, vertical direction along shafts 290 results in motion of fingers 294 in both vertical and horizontal directions, which is advantageous in reducing the complexity of the drive and the energy requirements.

Brackets 238 are pivotally mounted to conveyor 200 having free ends, with bags 12 being able to slide onto conveyor 200 by lands 228 and device 286 under brackets 238 in a first direction. To prevent bags 12 from unfolding on conveyor 200 after its removal from pockets 186 by lands 228 due to any tendency of bags 12 to pivot about their folds to a linear condition, lateral slide bars 240 are secured to brackets 238 for resting upon and slideably abutting with the central portion of bags 12 as bags 12 are being conveyed by conveyors 200. In the most preferred form, the placement of the pivots of brackets 238 prevents brackets 238 and thus slide bars 240 from pivoting toward conveyors 200 beyond a generally parallel position thereto to prevent excessive force from being placed upon bags 12 by brackets 238 and slide bars 240 while allowing brackets 238 to pivot away from conveyors 200 for ease of access to conveyors 200.

After ejecting device 170, carrier bars 30 and fixtures 32 move in intermittent positions along the horizontal portion of the closed loops of chains 24 for loading bags 12 into fixtures 32.

It should be appreciated that various overload protection devices can be utilized to stop operation of apparatus 10 or a particular station thereof in the event of a jam or other interruption in the collapsing, sealing, folding, ejection, and/or removal operation.

Now that the basic construction and operation of apparatus 10 according to the preferred teachings of the present invention have been explained, many extentions and variations may be obvious to a person skilled in the art. For example, although fixtures 32 have been shown and described as being formed of nonmovable parts, fixtures 32 can be of a hinged type which include legs which are openable and closeable. For example, the legs could be biased by springs to a normally closed position and can be cammed open against the bias of the springs. Vacuum suction cups could be provided to the legs of the fixtures to attach to the bag surfaces for opening with bags when the legs are hinged open, with the suction cups being continuously under vacuum or intermittently under vacuum only in the task positions where opening of the bag is desired. The legs of fixtures 32 can be shaped to correspond to the filled shape of bags 12.

Likewise, fixtures 32 could include a spring or like clamping member which sandwiches bags 12 in fixtures 32 to prevent bags 12 from slipping out of fixtures 32 during movement of fixtures 32 about the closed loops of chains 24. Suitable apparatus such as suction cups may be necessary to pull back such spring or clamping member during removal operations.

Although bags 12 have been described in the most preferred form as microwave popcorn popping bags 12 and specifically are folded into a central portion having first and second wing portions and in the most preferred form into thirds, bags 12 could be loaded into fixtures 32 in an unfolded condition and not be folded in ejecting device 170 where bags 12 are not desired to be folded in the final form. Similarly, bags 12 could be filled with other types of product than popcorn kernels such as but not limited to baking ingredients such as cake mixes, sauces such as catsup, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for removal of a bag from a land as the land moves to an inner position from an outer position comprising, in combination: a finger having a free end for engaging with the bag; and means for carrying the finger between a first position and a second position, with the free end of the finger being in a spaced condition from the bag and the land in the first position and with the free end of the finger abutting with the bag in the second position, with the finger being in the first position while the land and the bag moves from the inner position to the outer position and being in the second position and abutting with the bag on the land while the land moves from the outer position to the inner position to remove the bag from the land.

2. The removal device of claim 1 wherein the carrying means further includes means for moving the free end of the finger in a direction generally perpendicular to the direction of movement between the first and second positions.

3. The removal device of claim 2 wherein the carrying means comprises, in combination: a carriage; means for moving the carriage in the direction of movement between the first and second positions; means for pivotally mounting the finger to the carriage; and means for pivoting the finger relative to the carriage as the carriage moves.

4. The removal device of claim 3 wherein the pivoting means comprises, in combination: a stationary cam; and a cam follower secured to the finger for engaging with the stationary cam as the carriage moves.

5. The removal device of claim 3 wherein the carriage moving means comprises, in combination: means for slideably mounting the carriage; and means for reciprocating the carriage on the slideably mounting means.

6. The removal device of claim 1 wherein the carrying means comprises, in combination: a carriage; means for slideably mounting the carriage for movement in the direction of movement between the first and second positions; and means for reciprocating the carriage on the slideably mounting means, with the finger being carried by the carriage.

7. Device for ejecting a bag from a fixture movable in a lane in an operational direction from a first position to a second position comprising, in combination: a first pushing plate; a second pushing plate; means for moving the second pushing plate between a retracted position and an extended position, with the second pushing plate ejecting bags from the fixture in the second position when moved from the retracted position to the extended position; and means for releasably securing the first pushing plate to the second pushing plate for movement with the second pushing plate, with the first pushing plate ejecting bags from the fixture in the first position when the second pushing plate is moved from the retracted position to the extended position.

8. The device of claim 7 further comprising, in combination: means for holding the first pushing plate stationary when the first pushing plate is released from the second pushing plate and while the second pushing plate is moved from the retracted position to the extended position.

9. The device of claim 7 wherein the releasably securing means comprises, in combination: a pin carried by the second pushing plate having an extended position and a retracted position; and an aperture formed in the first pushing plate for receiving the pin in its extended position.

10. The device of claim 7 wherein the fixture is movable in the operational direction from an initial position to the first position; and wherein the device further comprises a stationary bending bar, with the bag having a portion located in the fixture and a portion extending beyond the fixture, with the portion of the bag extending beyond the fixture engaging the stationary bending bar as the fixture moves from the initial position to the first position to create a fold in the bag, with the stationary bending bar holding the portion of the bag extending beyond the fixture at an angle other than 180° to the portion of the bag located in the fixture when the fixture is in the first position and before the bag is ejected from the fixture.

11. Device for ejecting a bag from a fixture movable in a lane in an operational direction from a first position to a second position, with the bag having a portion located in the fixture and a portion extending beyond the fixture, comprising, in combination: a pushing plate; means for moving the pushing plate in a movement direction between a retracted position and an extended position, with the pushing plate ejecting bags from the fixture in the second position when the pushing plate moves from the retracted position to the extended position; and a stationary bending bar, with the portion of the bag extending beyond the fixture engaging the stationary bending bar as the fixture moves from the first position to the second position to create a fold in the bag, with the stationary bending bar holding the portion of the bag extending beyond the fixture at an angle other than 180° to the portion of the bag located in the fixture when the fixture is in the second position and before the bag is ejected from the fixture.

12. The device of claim 11 further comprising, in combination: a pocket located in line with the movement direction of the pushing plate from the fixture, with the pocket being of a size for slideable receipt of the bag with the portion of the bag extending beyond the fixture being generally parallel to the portion of the bag located in the fixture, with the pocket slideably receiving the bag when the bag is ejected from the fixture by the pushing plate.

13. The device of claim 12 further comprising, in combination: means for moving the pocket from a first position to a second, inverted position, with the pocket receiving the bag from the fixture in the first position; and means for removing the bag from the pocket in the second, inverted position.

14. The device of claim 13 wherein the moving means comprises means for rotating the pocket about an axis between the first and second positions.

15. The device of claim 14 wherein the removing means comprises, in combination: a land, with the land including a lug for abutting with the bag in the pocket; and means for moving the land in a movement direction between a first position and a second position, with the land in its first position being in a non-interferring position with the pocket and the rotation between the first and second positions of the pocket, with the lug pushing the bag from the pocket in the second, inverted position onto the land as the land moves from the first position to the second position, with the bag being removed from the pocket and supported by the land in the second position of the land.

16. The device of claim 15 wherein the land moving means comprises means for pivoting the land between a first, parallel position to the pocket and a second position at a nonlinear angle to the first, parallel position.

17. The device of claim 16 wherein the land moving means comprises, in combination: an upright movable between the first and second positions of the land; and means for pivotally mounting the land to the upright; and wherein the land pivoting means comprises, in combination: a cam mounted to the land; and a stationary cam track, with the cam moving in the cam track as the upright moves between the first and second positions of the land.

18. The device of claim 15 further comprising, in combination: means for preventing the bag from riding back with the land as the land moves from the second position to the first position.

19. The device of claim 18 wherein the preventing means comprises, in combination: a finger having a free end for engaging with the bag; and means for carrying the finger between a first position and a second position, with the free end of the finger being in a spaced condition from the bag and the land in the first position and with the free end of the finger abutting with the bag in the second position, with the finger being in the first position while the land and the bag moves from the first position to the second position and with the finger being in the second position while the land moves from the second position to the first position.

20. The device of claim 19 wherein the carrying means further includes means for moving the free end of the finger in a direction generally perpendicular to the direction of movement between the first and second positions of the finger.

21. The device of claim 20 wherein the carrying means comprises, in combination: a carriage; means for moving the carriage in the direction of movement between the first and second positions of the finger; means for pivotally mounting the finger to the carriage; and means for pivoting the finger relative to the carriage as the carriage moves.

22. The device of claim 21 wherein the pivoting means comprises, in combination: a stationary cam; and a cam follower secured to the finger for engaging with the stationary cam as the carriage moves.

23. The device of claim 22 wherein the carriage moving means comprises, in combination: means for slideably mounting the carriage; and means for reciprocating the carriage on the slideably mounting means.

24. The device of claim 19 wherein the carrying means comprises, in combination: a carriage; means for slideably mounting the carriage for movement in the direction of movement between the first and second positions of the finger; and means for reciprocating the carriage on the slideably mounting means, with the finger being carried by the carriage.

25. The device of claim 15 further comprising, in combination: means for conveying the bags in a direction perpendicular to the movement direction of the land after the land moves from the second position to the first position; a bracket having a free end; means for pivotally mounting the bracket about an axis perpendicular to the movement direction of the land, with the bag on the land pivoting the bracket allowing passage of the bag beyond the free end of the bracket as the bag and the land move to the second position of the land; and at least a first slide bar secured to the bracket for slideably abutting with the bag being conveyed on the conveying means.

26. The device of claim 11 wherein the operation direction includes a first portion and a second portion, with the first portion being generally perpendicular to the second portion; and wherein the stationary bending bar prevents the bags from moving from the fixtures under centrifugal forces as the fixtures move from the first portion to the second portion, with the stationary bending bar having an inlet spaced from the fixture to an extent equal to that of the portion of the bag extending beyond the fixture.

27. Device for ejecting a bag comprising, in combination: a pushing plate; means for moving the pushing plate in a movement direction between a retracted position and an extended position; a fixture for slideably receiving the bag, with the bag being slideable into the fixture in a first direction; means for moving the fixture in a lane in an operation direction to an intermittent position, with the pushing plate ejecting bags from the fixture in the intermittent position opposite to the first direction when the pushing plate moves from the retracted position to the extended position; and a pocket located in line with the movement direction of the pushing plate from the fixture in the intermittent position, with the pocket being of a size for slideable receipt of the bag, with the pocket slideably receiving the bag when the bag is ejected from the fixture by the pushing plate.

28. The device of claim 27 wherein the means for moving the fixture includes a carrier bar, with the fixture secured to the carrier bar, with the carrier bar including an aperture, with the pushing plate passing through the aperture of the carrier bar when the pushing plate moves from the retracted position to the extended position.

29. Method for ejecting a bag from a fixture, with the bag being slid into the fixture in a first direction comprising the steps of: moving a pushing plate in a movement direction between a retracted position and an extended position, with the pushing plate ejecting bags from the fixture opposite to the first direction when the pushing plate moves from the retracted position to the extended position; providing a pocket of a size for slideable receipt of the bag; and locating the pocket in line with the movement direction of the pushing plate from the fixture and for slideably receiving the bag when the bag is ejected from the fixture by the pushing plate.

30. Device for ejecting a bag from a fixture comprising, in combination: a pushing plate; means for moving the pushing plate in a movement direction between a retracted position and an extended position, with the pushing plate ejecting bags from the fixture when the pushing plate moves from the retracted position to the extended position; a pocket located in line with the movement direction of the pushing plate from the fixture, with the pocket being of a size for slideable receipt of the bag, with the pocket slideably receiving the bag when the bag is ejected from the fixture by the pushing plate; means for moving the pocket from a first position to a second, inverted position, with the pocket receiving the bag from the fixture in the first position; and means for removing the bag from the pocket in the second, inverted position; wherein the removing means comprises, in combination: a land, with the land including a lug for abutting with the bag in the pocket; and means for moving the land in a movement direction between a first position and a second position, with the land in its first position being in a non-interferring position with the pocket and the rotation between the first and second positions of the pocket, with the lug pushing the bag from the pocket in the second, inverted position onto the land as the land moves from the first position to the second position, with the bag being removed from the pocket and supported by the land in the second position of the land.

31. The device of claim 30 wherein the moving means comprises means for rotating the pocket about an axis between the first and second positions.

32. Device for a bag comprising, in combination: a pocket for receipt of the bag; means for moving the pocket from a first position to a second, inverted position, with the pocket receiving the bag in the first position; and means for removing the bag from the pocket in the second, inverted position; wherein the removing means comprises, in combination: a land, with the land including a lug for abutting with the bag in the pocket; and means for moving the land in a movement direction between a first position and a second position, with the land in its first position being in a non-interferring position with the pocket moving between the first and second positions of the pocket, with the lug pushing the bag from the pocket in the second, inverted position onto the land as the land moves from the first position to the second position, with the bag being removed from the pocket and supported by the land in the second position of the land.

33. The device of claim 32 wherein the moving means comprises means for rotating the pocket about an axis between the first and second positions.

34. The device of claim 32 wherein the land moving means comprises means for pivoting the land between a first parallel position to the pocket and a second position at an angle other than 180° to the first, parallel position.

35. The device of claim 34 wherein the land moving means comprises, in combination: an upright movable between the first and second positions of the land; and means for pivotally mounting the land to the upright; and wherein the land pivoting means comprises, in combination: a cam mounted to the land; and a stationary cam track, with the cam moving in the cam track as the upright moves between the first and second positions of the land.

36. Method for sliding a bag from a pocket comprising the steps of: moving a land in a movement direction between a first position and a second position, with the land including a lug for abutting with the bag in the pocket, with the land in its first position being in a non-interferring position with the pocket, with the lug pushing the bag from the pocket onto the land as the land moves from the first position to the second position, with the bag being removed from the pocket and supported by the land in the second position of the land.

37. Method for ejecting a bag from a fixture movable in an operational direction from a first position to a second position comprising the steps of: moving a first pushing plate between a retracted position and an extended position, with the first pushing plate ejecting bags from the fixture in the second position when moved from the retracted position to the extended position; and releasably securing a second pushing plate to the first pushing plate for movement with the first pushing plate, with the second pushing plate ejecting bags from the fixture in the first position when the first pushing plate is moved from the retracted position to the extended position.

38. Method for ejecting a bag from a fixture movable in an operational direction from a first position to a second position, with the bag having a portion located in the fixture and a portion extending beyond the fixture, comprising the steps of: bending the portion of the bag extending beyond the fixture as the fixture moves from the first position to the second position to create a fold in the bag; holding the portion of the bag extending beyond the fixture at a nonlinear angle to the portion of the bag located in the fixture when the fixture is in the second position; and ejecting the bag from the fixture in the second position for folding the portion of the bag extending beyond the fixture about the fold in the bag to overlie the portion of the bag previously located in the fixture.

39. The method of claim 38 wherein the ejecting step comprises the step of moving a pushing plate in a movement direction between a retracted position and an extended position, with the pushing plate ejecting bags from the fixture in the second position when the pushing plate moves from the retracted position to the extended position.

40. Method for moving a bag comprising the steps of: moving a land between an inner position and an outer position; placing the bag on the land in its inner position for movement with the land to its outer position; carrying a finger having a free end between a first position and a second position, with the free end of the finger being in a spaced condition from the bag and the land in the first position and with the free end of the finger abutting with the bag in the second position, with the finger being in the first position while the land and the bag moves from the inner position to the outer position and being in the second position and abutting with the bag on the land while the land moves from the outer position to the inner position to remove the bag from the land; and simultaneously pivoting the finger about an axis generally perpendicular to the movement direction of the land between the inner and outer positions as the finger is carried between the first and second positions.

* * * * *